United States Patent [19]

Maurer

[11] 4,087,931

[45] May 9, 1978

[54] ANIMATED TOY

[75] Inventor: Donald John Maurer, Torrance, Calif.

[73] Assignee: Mattel, Inc., Hawthorne, Calif.

[21] Appl. No.: 652,435

[22] Filed: Jan. 26, 1976

[51] Int. Cl.[2] ..... A63H 11/10

[52] U.S. Cl. ..... 46/107; 46/204

[58] Field of Search ..... 46/106, 107, 99, 104, 46/101, 204, 205, 202, 92, 112

[56] References Cited

U.S. PATENT DOCUMENTS

| | | | |
|---|---|---|---|
| 1,329,338 | 1/1920 | Fuld | 46/107 |
| 2,251,006 | 7/1941 | Savage | 46/107 |
| 2,454,375 | 11/1948 | Bush | 46/107 |
| 2,475,072 | 7/1949 | Behrens | 46/104 |
| 2,820,324 | 1/1958 | Echelmeier | 46/106 |
| 3,826,039 | 7/1974 | Disko | 46/106 |

FOREIGN PATENT DOCUMENTS

| | | | |
|---|---|---|---|
| 1,211,031 | 10/1959 | France | 46/112 |

*Primary Examiner*—F. Barry Shay

*Attorney, Agent, or Firm*—John G. Mesaros; Max E. Shirk; Stephen L. King

[57] ABSTRACT

An animated toy is disclosed containing, in combination, a toy figurine, decorated as a scuba swimmer, adapted to be placed in a belly down prone position atop a carriage. The figurine includes a torso and first and second legs pivotally coupled to said torso. A wheel is rotatably coupled to the carriage and rotates responsive to movement of the carriage along a supporting surface. And a leg pivoting means is supported by the carriage, for engaging the front side of said figurine's legs for alternately forcing each of said legs to pivot upwardly responsive to the rotation of said wheel. The figurine's legs alternately move up and down to simulate a swimmer's kick as the user moves the toy figurine and carriage along a supporting surface.

6 Claims, 7 Drawing Figures

ANIMATED TOY

FIELD OF THE INVENTION

This invention relates to animated toys and, more particularly, to an animated toy which simulates a swimmer's kicking motion.

BACKGROUND OF THE INVENTION

The animated toy figurine is one known type of children's plaything. In this, one or more of the figurine's appendages or other body parts may be moved to create a semblance of live action that amuses and interests the child. One type of prior art animated toy figurine which is known are the toys sold under the tradmark "Putter-people" by Mattel Company, Inc., Hawthorne, California, assignee of the present invention. Usually such animated toys are incorporated in or as part of a complete setting of toys including buildings, carriers and the like. As a complete setting a large variety of different elements are provided to maintain the child's interest for a reasonable duration. One setting for such types of toys, as is known, is the aquatic setting or, more specifically, a military aquatic setting employing scuba divers or frogmen, generally designated as swimmers, sailors, and naval vessels, such as submarines, as well as other related equipment. As is evidenced by some prior art patents, which have been made known to me, animated toy figurines which simulate a swimmer's movement is old and known, such as presented in U.S. Pat. Nos. 3,153,879 and 3,601,922. As is shown in such prior art patents, the swimming figurines involve relatively complex mechanical structures and they appear to be adapted for use in water.

OBJECTS OF THE INVENTION

The present invention is directed to an animated toy, useful in military aquatic setting, adapted to simulate a swimmer's kicking movement in an out-of-water setting as it is being moved by the user along a supporting surface.

Additionally, an object of the invention is to provide a toy figurine and carriage combination of relatively inexpensive, simple and durable construction, in which the figurine simulates a scuba diver's kick as it is moved along an out-of-water surface.

BRIEF SUMMARY OF THE INVENTION

The present invention includes a toy figurine decorated to simulate a scuba diver or frogman, which may generically be referred to as a swimmer, adapted to be positioned in a belly down prone position. The figurine includes a torso portion and first and second legs that are pivotally coupled to the torso. A carriage is provided which is adapted to carry the aforedescribed figurine in the belly down prone position. A wheel is coupled to the carriage and rotates responsive to the child gripping and moving the carriage along a supporting surface and a leg pivoting means is supported by the carriage for engaging the front side of the legs of the figurine for alternately forcing each leg to pivot upwardly responsive to rotation of the aforementioned wheel. In this manner, as the child moves the combination of figurine and carriage along a surface, each leg in turn is pivoted up and then by its own weight pivots down thereby simulating a swimmer's kicking movement.

In one specific form of the invention the leg pivoting means includes a cam means, such as an eccentric, coupled to a pivotable lever and coupled for joint rotation with the wheel. In turn, the pivotable lever includes an end portion which underlies and engages the figurine's leg. The elements cooperate together with the wheel rotating and turning the cam, the cam pivoting the lever back and forth, and the lever end forcing the swimmer's leg to pivot up and then releasing the leg.

In another specific embodiment, the wheel is mounted to a shaft and a pair of eccentrics or cams, as variously termed, are mounted to the same shaft for joint rotation with the wheel, with one cam located to either side of said wheel. The cams are located on the carriage in a position underlying the first and second legs, respectively, of the simulated swimmer and in which the cams engage and raise the swimmer's legs. In a further aspect of this latter embodiment, the carriage includes two pairs of carriage wheels with each one of the carriage wheels in one pair mounted to the carriage for rotation about a common axis and with each one of the wheels in the remaining pair mounted for rotation about a second common axis, and with said two axes spaced from one another. Further, the wheel shaft is located in between said two common axes. The four wheels define a plane tangent to their outer periphery surface most remote from the carriage, which is the plane of a flat supporting surface on which the carriage is moved. The wheel is of a radius and is supported such that the distance from its axis of rotation to the outer periphery thereof is just short of the aforedescribed defined plane so that in the normal condition the carriage and the carried scuba diver may be propelled along a surface without moving the main wheel and, alternatively, by gripping the carriage and swimmer to exert a downward pressure the carriage yields slightly to move the main wheel downwardly to engage the same supporting surface as the two pairs of wheels, whereby movement of the carriage results in turning the main wheel to cause simulation of the scuba diver's kicking motion.

The foregoing objects and advantages of the invention as well as the structure characteristic of the invention, and modifications and improvements thereto, become more apparent to the reader from a consideration of the detailed description of the preferred embodiments of the invention which follows, taken together with the illustrations thereof presented in the accompanying figures of the drawings.

DETAILED DESCRIPTION

Figure 1:
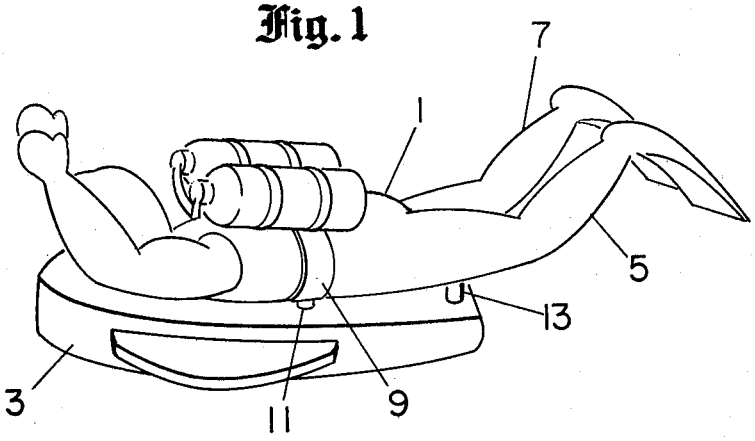
FIG. 1 is a top side perspective view of one embodiment of the animated toy.

The toy combination presented in FIG. 1 includes the toy figurine 1, supported atop a carrier or carriage 3. The toy figurine is shown decorated in the style of a swimmer commonly known as a scuba diver or frogman, depicted in a wet suit and carrying oxygen tanks on his back side. Each of the legs 5 and 7 is mounted or coupled pivotally to the torso by a joint, such as a pin joint, of conventional structure not visible in this figure, which allows the legs to pivot upwardly from a normal position and then be lowered back to the normal position. Suitably, the figurine is shown held in a belly down prone position atop carriage 3, by use of a flexible strap or clamp 9 attached to a prong 11 that is integrally formed in carriage 3. Except as otherwise noted, all of the elements may be constructed of various types of plastic material so as to be relatively inexpensive in structure and yet relatively durable.

A pin 13 extends from the underside of the carriage to a position engaging the front side of leg 5. A like pin, not visible in this figure, in like manner extends through an opening in the carriage to a position underlying the front side of leg 7.

Figure 2:
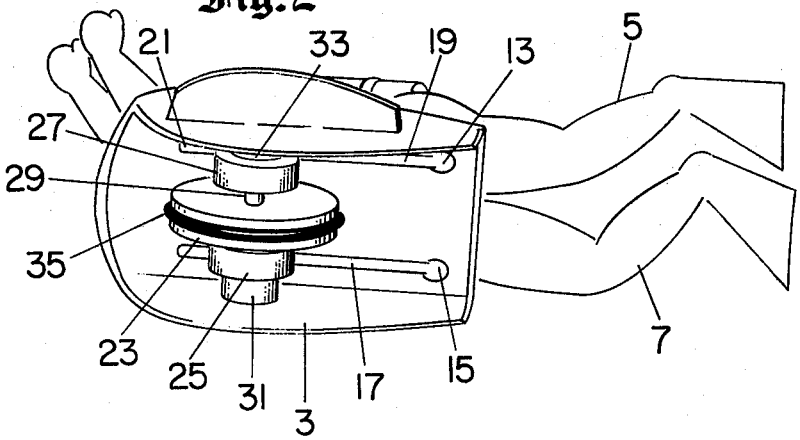
FIG. 2 is a bottom side perspective view of the embodiment of FIG. 1.

The embodiment of FIG. 1 is turned over as viewed in FIG. 2 and reveals the operating mechanisms mounted to the underside of carriage 3. The pin 13, underlying leg 5, is partially visible in this figure and the corresponding end of the second pin 15 is shown in position extending through the passage in the carriage surface to a position for engaging the front side of figurine leg 7. Pins 15 and 13 are carried by and from an end of lever arms 17 and 19, respectively. Lever arm 19 is connected at one end to a depending side of the chassis by a shaft 21 about which lever arm 19 pivots. A similar pivotable coupling is provided for lever arm 17 but is not visible in this figure. A wheel 23 and a pair of eccentrics or cams 25 and 27 are shown mounted to a common shaft 29 supported to the chassis by journals 31 and 33. The cams are arranged about the shaft so that the lobe of one is suitably oriented diametrically opposite that of the lobe of the other about the axis of the shaft and each cam overlies a respective one of the two lever arms. Suitably, a rubber O-ring 35 is attached to the wheel 23 so as to provide better friction between a supporting surface on which the carriage is moved than is possible with the plastic material of the main wheel portion 23.

Figure 3:
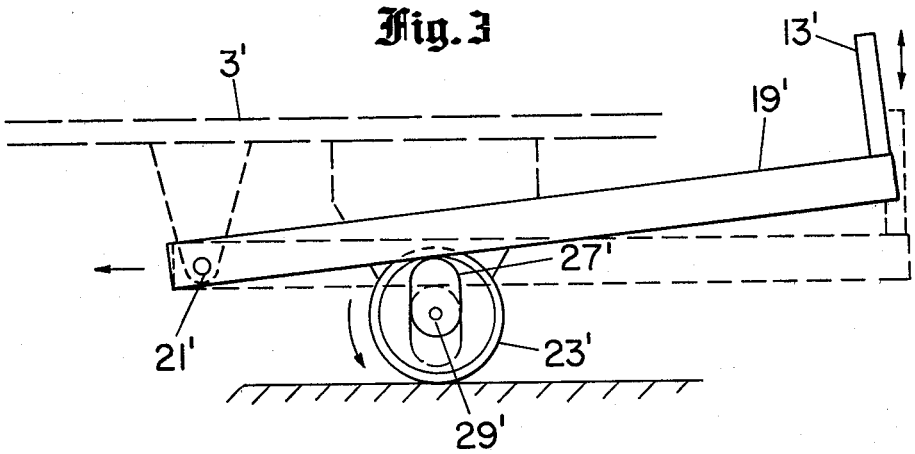
FIG. 3 is a schematic illustration of a part of the mechanical structure used in the aforedescribed embodiment.

When the child grips the embodiment of FIG. 1 and moves the carriage along a surface, wheel 23 rotates. Wheel 23 drives shaft 29 which, in turn, drives cams 21 and 25 causing them to rotate. The lobe of the cam 27 during a portion of its revolution, abuts arm 9 causing it to pivot about is coupling 21 moving pin 13 upward. As is more clearly shown in FIG. 1, the upward movement of pin 13 engages and raises leg 5 to an upward position. As the cam continues to revolve so that the cam lobe is oriented away from the lever arm 19, the pin 13 moves downwardly and leg 5, under its own weight, lowers. This action is perhaps more easily visualized in connection with the schematic illustration of FIG. 3 where the aforedescribed elements are labeled with the same numerals primed. Thus, as wheel 23′ rotates, as is shown by the arrow, about the shaft 29′, the lobe of eccentric cam 27′ abuts against lever 19′ forcing the lever and its carried end portion 13′ to pivot upwardly about its pivot point 21′. As the wheel revolves further and the cam lobe moves to a lower position, as indicated by the dotted lines, the lever arm 19′ lowers to a position shown by the dash line.

Returning again to FIGS. 1 and 2, a similar action occurs with the revolution of cam 25, lever arm 17, pin 15 and leg 7. Inasmuch as the lobe of cam 21 is oriented about the shaft axis by an angle of 180° from the angle of cam lobe of cam 25, when pin 13 is raised, pin 15 is in its lowered position. The effect is that the legs alternately flip or kick with leg 5 being raised while leg 7 is being lowered to thus simulate the kicking motion of a swimmer.

Figure 4:
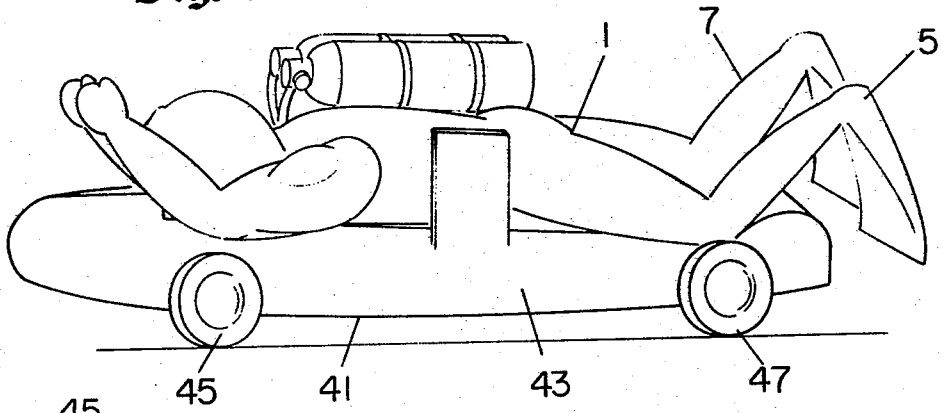
FIG. 4 is a side perspective view of a second embodiment of the invention.

Reference is now made to FIG. 4 which illustrates in side perspective a second embodiment of the invention more versatile than the first and is thus preferred to that previously described.

For convenience, the toy figurine previously described in the preceding embodiment is also employed in this embodiment. Accordingly, the identifying numerals used in the illustrations of FIG. 1 and FIG. 2 to identify the parts of the figurine are used in FIG. 4 and the succeeding figures. Thus the figurine 1 is illustrated in a belly down prone position atop the surface of a carriage 41, with its legs 5 and 7 as shown pivotably coupled to the figurine's torso. The figurine is held in place with the assistance of a flexible web 43 and a corresponding upstanding web of like character similarly attached to the carriage, located on the other side but not visible in this figure, that clampingly engage the figurine. The carriage 41 includes a front wheel 45, which is one of a pair of wheels, and a rear wheel 47, which is one of a second pair of wheels, which are better described in connection with the illustrations of FIGS. 5 and 6.

In order to bring out in greater detail the elements of the carriage in this embodiment, toy figurine 1 is illustrated in outline by invisible lines. The carriage 43 includes a first pair of wheels 45 and 46, joined by separate axles 48 and 49, rotatably coupled to the chassis by means of joint 51. The axles are oriented for rotation about a common axis. The second pair of wheels includes wheels 47 and 53 which are attached by axles 55 and 57 to the carriage for rotation about a second common axis. The axles may included any conventional bearing or journal surfaces formed in the chassis. A wheel 55, a first eccentric type cam 58 and a second eccentric type cam 60 are joined together by a common shaft 61 for joint rotation about the shaft axis, represented as 63.

Suitable, the lobes of the cams are oriented in opposite directions or, as otherwise termed, 180° apart about the axis of shaft 61.

A strip 65 is visible in this figure which is described in greater detail hereafter. The arrangement is such that the leg 5 of the figurine overlies cam 58 and leg 7 overlies cam 60 and wheel 56 is positioned between the legs. As was previously noted, each of the legs 5 and 7 is pivotable about an axis which is represented in this figure as 6.

Figure 5:
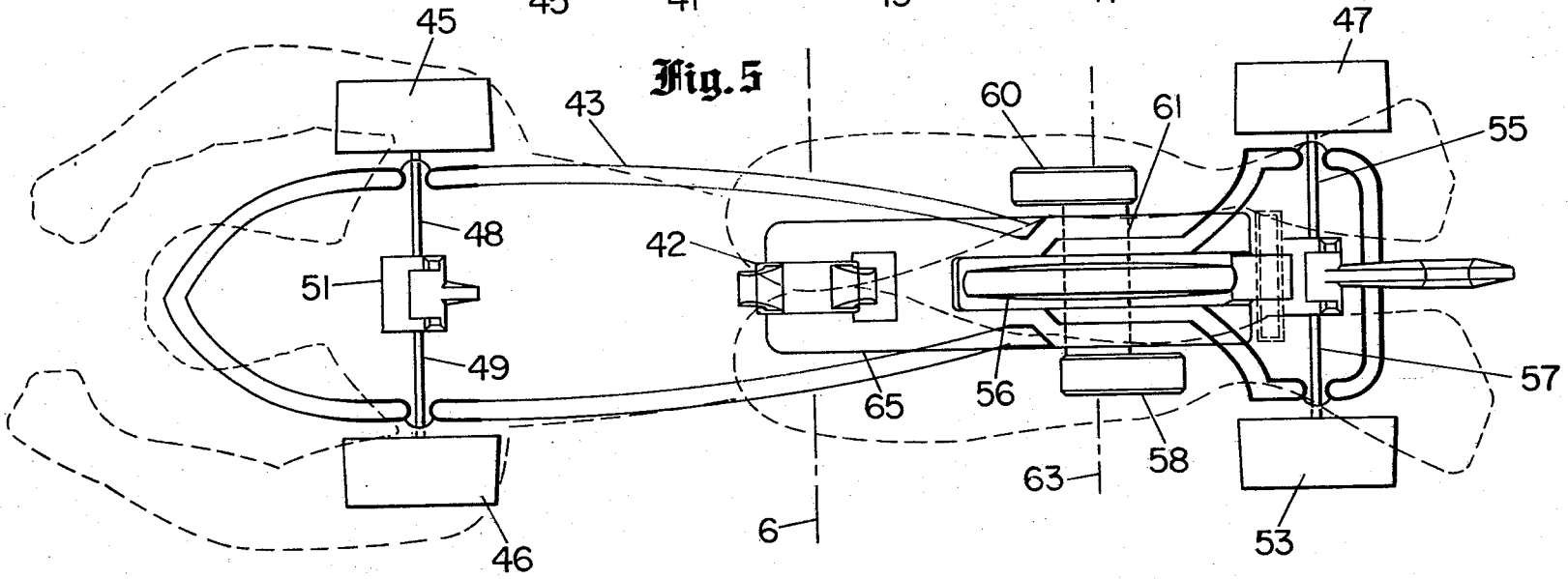
FIG. 5 is a top plan view of the embodiment of FIG. 4.
Figure 6:
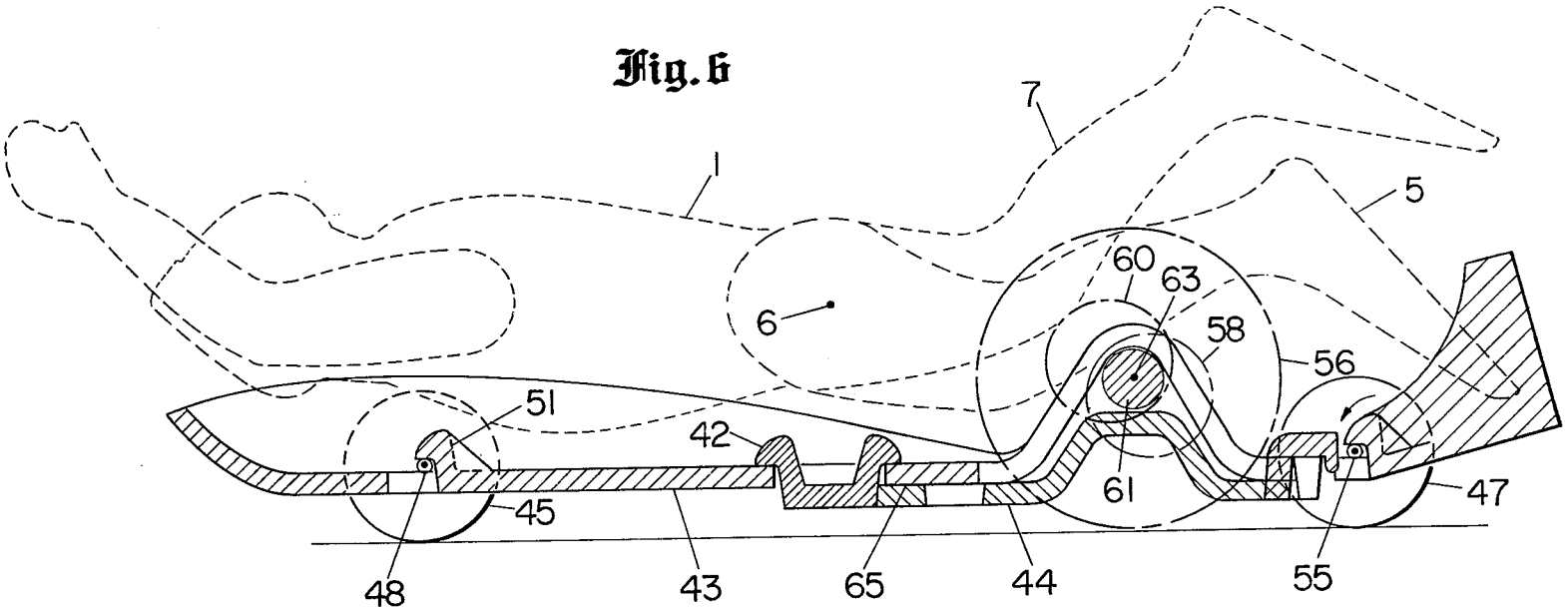
FIG. 6 is a cross-section taken along the lines A—A of FIG. 5.

A cross-section taken along section lines A—A of FIG. 5 is presented as FIG. 6 which is next considered. As before, figurine 1 is represented in invisible lines for clarity and, likewise for clarity, wheel 56 is represented in invisible lines. Further, leg 5 is illustrated in this view as well as cam 58, although technically speaking, that leg would not be visible in the section drawing. The cam 60 is shown rotated to a position about axis 63 of shaft 61 so that the leg 7 is in the raised position. By contrast, the cam 58 which has its lobe oriented 180° apart from the lobe of cam 60 leaves leg 5 in the lowered position. It is noted that by rotating wheel 56 by 180° or one-half revolution about its axis, the position of cam 60 becomes that presently depicted for cam 58 and the position of leg 7 becomes that depicted in this figure for leg 5, and vice versa for cam 58 and leg 5. Shaft 61 is rotatably coupled or mounted to the carriage 43 by means of the strip or web 65 which forms a U-shaped bend and chassis portion 44 underlying this strip which also forms a U-shaped bend with strip 65 held to the strip 44 by the attaching integral grommet 42. The U-shaped portions are fitted within one another leaving therewithin a shaft receiving space. Additionally, the inverted U-shaped bend in one of the strips which is integrally formed in the carriage surface makes the carriage surface more flexible transversely for reasons that become more apparent hereinafter.

As is illustrated in this figure, the carriage is seated upon a supporting surface 68, symbolically represented. The plane surface is defined by a plane going through the outer periphery of each of the four carriage wheels including wheel 45 of the first pair and wheel 47 of the second pair. In the normal position shown, the shaft is supported at a distance above that plane surface so that the outer periphery of wheel 56 is slightly above the plane of supporting surface 68, generally represented as delta D in the figure.

The carriage is made of plastic material which, as is known, is flexible and by applying a suitable downward force or pressure, in excess of the weight of the figurine, the force causes the plastic to resiliently yield and upon removal of the pressure the plastic will restore to its normal condition.

Figure 7:
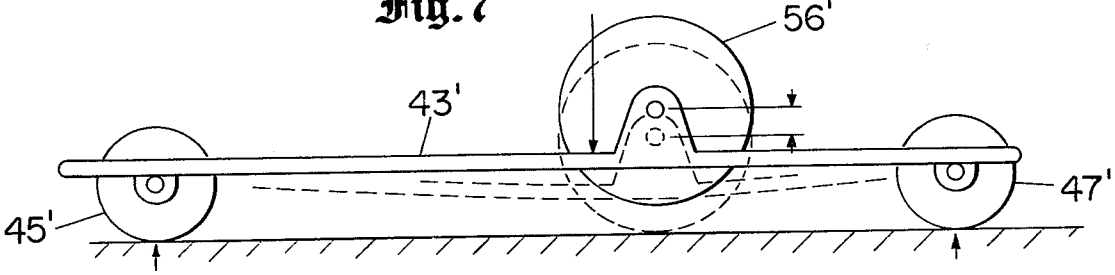
FIG. 7 is a schematic illustration representing an aspect of the second embodiment.

As is apparent from FIG. 6, the toy combination may be rolled along a supporting surface, as by pushing from the rear to propel the toy or by rolling the toy down a ramp. In so doing, the wheel 56 which drives cams 58 and 60 does not contact the supporting surface and, hence, the figurine's legs remain in a stable position. However, by gripping the figurine and applying a downward pressure, the shaft 61 moves downwardly as the strips 65 and 44 resiliently yield, causing wheel 56 to engage the plane surface. With that pressure maintained, the user may then move the toy combination longitudinally to cause rotation of wheel 56. As wheel 56 rotates, the cams 58 and 60 rotate to alternately raise and then lower legs 7 and 5, respectively. For convenience, I have schematically represented this aspect of the invention of FIG. 6 in schematic form as in FIG. 7. Thus when a force F is applied to the flexible base 43', the wheel 56' is moved downwardly to the position shown by the dashed lines, as well as causing the surface 43' to yield, as also shown in dashed lines, so that the outer periphery of the wheel 56' engages the supporting surface or plane tangent to the outer periphery of wheels 45' and 47'. The animated toy of this embodiment may thus, for example, be rolled down a ramp without causing the figurine's legs to simulate a kicking movement. By gripping and moving the figurine and applying a slight downward pressure, the driving wheel 56 will engage the supporting surface and revolve, resulting in alternate raising and lowering of the respective legs to simulate the kicking action of a swimmer.

It is believed that the foregoing description of the preferred embodiments of the invention is sufficient in detail to enable one skilled in the art to make and use same. However, it is expressly understood that the invention is not to be limited to those details presented for the foregoing purpose inasmuch as various substitutions of equivalent elements as well as modifications and improvements to the foregoing embodiments can be made by one skilled in the art upon reading this specification, all of which come within the scope of the invention. Accordingly, it is respectfully requested that the invention be broadly construed within the full spirit and scope of the appended claims.

What is claimed is:

1. An animated toy comprising in combination:

a toy figurine having a predetermined weight, decorated to simulate a swimmer, said figurine having a torso and first and second legs with said legs being coupled pivotally to said torso for pivotal movement therebetween;

a carriage for carrying said figurine in a belly down prone position, said carriage including:

a surface for receiving and carrying said figurine;

a first pair of wheels; and a second pair of wheels, spaced from said first;

each of said pairs of wheels being rotatably coupled to said carriage for movably supporting said carriage;

and wherein the outer periphery of said wheels beneath said carriage and most remote from said surface defines a support plane tangent to the outer peripheries of all said wheels;

driving wheel means;

a first cam means;

a second cam means; and a shaft; each of said cam means and wheel means being coupled to said shaft for joint rotation therewith, with said wheel means located in between said first and second cam means; and means rotatably coupling said shaft to said carriage at a location between said first and second wheel pairs;

said shaft supporting said driving wheel means with the outer periphery of said driving wheel means located normally slightly above said support plane;

said first cam means being positioned underlying said first leg of said figurine to engage and pivot said leg during rotation of said first cam means and said second cam means being positioned underlying said second leg of said figurine to engage and pivot said leg during rotation of said second cam means;

said first cam means being oriented on said shaft different from said second cam means for engaging and pivoting said respective first and second legs at different rotational positions of said shaft;

said carriage having a sufficient flexibility characteristic to resiliently yield responsive to a downward force greater than the weight of said figurine for lowering the outer periphery of said driving wheel means at least to said support plane;

whereby said carriage and figurine may be propelled along a surface or may be gripped and moved along a support surface causing said driving wheel to rotate and thereby causing said figurine's legs to alternately pivot, simulating a swimmer's kick.

2. The invention as defined in claim 1 wherein said means rotatably coupling said shaft to said carriage includes:

a first strip of plastic material having an inverted U-shaped portion;

a second strip of plastic material having an inverted U-shaped portion;

means coupling said first and second strips together with one of said U-shaped portions fitted within the other and defining a space which receives said shaft between those portions.

3. The invention as defined in claim 2 wherein one of said first and second strips comprises an integral portion of said carriage to increase the transverse flexibility of said surface.

4. The invention as defined in claim 1 further comprising holding means for holding said figurine on said carriage.

5. An animated toy comprising in combination:

a toy figurine adapted to be positioned in a belly down prone position, said figurine including a torso and first and second legs pivotally coupled to said torso;

support means having an upper surface for carrying said figurine in a belly down prone position;

wheel means rotatably coupled to said support means for revolving responsive to movement of said support means along a supporting surface with said wheel means in firm contact therewith;

leg pivoting means supported by said support means and engaging the front side of said figurine's legs for alternately pivoting each of said legs upwardly responsive to revolving of said wheel means whereby said legs pivot up and down to simulate a kick stroke when said support means is rolled along a supporting surface;

a first and second pair of carriage wheels for transporting said support means;

first axle means rotatably coupling said first pair of wheels to said support means at a location in front of said wheel means;

second axle means rotatably coupling said second pair of carriage wheels to said support means at a location behind said wheel means, said first and second pairs of wheels being arranged to support said support means on a supporting surface with said wheel means above and out of contact with said supporting surface; and said support means possessing a flexibility characteristic responsive to downward pressure for lowering said wheel means into contact with said supporting surface.

6. The invention as defined in claim 5 further comprising holding means for holding said figurine on said support means.

* * * * *